US008127887B2

(12) United States Patent
Terashima et al.

(10) Patent No.: US 8,127,887 B2
(45) Date of Patent: Mar. 6, 2012

(54) VEHICLE INCLUDING SILENCER

(75) Inventors: Yasuto Terashima, Shizuoka-ken (JP); Takehito Yamamoto, Shizuoka-ken (JP)

(73) Assignee: Yamaha Hatsudoki Kabushiki Kaisha, Iwata-Shi (JP)

( * ) Notice: Subject to any disclaimer, the term of this patent is extended or adjusted under 35 U.S.C. 154(b) by 0 days.

(21) Appl. No.: 12/659,021

(22) Filed: Feb. 23, 2010

(65) Prior Publication Data

US 2010/0212990 A1 Aug. 26, 2010

(30) Foreign Application Priority Data

Feb. 24, 2009 (JP) ..... 2009-040716

(51) Int. Cl.
*F01N 1/02* (2006.01)

(52) U.S. Cl. ..... 181/251; 181/212; 181/227; 181/228

(58) Field of Classification Search ..... 181/212, 181/227, 228, 232, 249
See application file for complete search history.

(56) References Cited

U.S. PATENT DOCUMENTS

| | | | | | |
|---|---|---|---|---|---|
| 4,286,689 | A * | 9/1981 | Malmsten | 181/232 |
| 4,744,440 | A * | 5/1988 | Hanson | 181/227 |
| 5,444,197 | A * | 8/1995 | Flugger | 181/264 |
| 6,158,546 | A * | 12/2000 | Hanson et al. | 181/255 |
| 7,669,693 | B2 * | 3/2010 | Yamaguchi et al. | 181/255 |
| 2006/0201742 | A1 * | 9/2006 | Terashima et al. | 181/227 |
| 2007/0158136 | A1 * | 7/2007 | Shimomura et al. | 181/251 |

FOREIGN PATENT DOCUMENTS

| | | |
|---|---|---|
| JP | 01-118117 U | 8/1989 |
| JP | 04-093711 | 8/1992 |
| JP | 2003-262113 A | 9/2003 |
| JP | 2007-091132 A | 4/2007 |

* cited by examiner

*Primary Examiner* — Forrest M Phillips
(74) *Attorney, Agent, or Firm* — Rabin & Berdo, PC

(57) ABSTRACT

A vehicle, such as a motorcycle, can include an engine, an exhaust pipe, and a silencer. The silencer can include a main body and first and second pipes. An upstream end of the first pipe can be connected to the exhaust pipe, and be provided in the main body. The second pipe can be provided apart from the first pipe on the downstream side of the first pipe, coaxially with the first pipe, and extending through a downstream lid of an outer tube of the main body. The downstream portion of the first pipe can have an inner diameter that gradually decreases from the upstream side toward the downstream end. The upstream end of the second pipe can be provided in the main body and have a larger inner diameter than the inner diameter of the downstream end of the first pipe.

12 Claims, 12 Drawing Sheets

VEHICLE INCLUDING SILENCER

CROSS-REFERENCE TO RELATED APPLICATIONS

This application claims priority under 35 U.S.C. §119 from Japanese Patent Application No. JP 2009-040716, filed Feb. 24, 2009, the entirety of which is incorporated herein by reference.

BACKGROUND OF THE INVENTION

1. Field of the Invention

Embodiments of the present invention relate to a vehicle, such as a motorcycle, and more specifically to a motorcycle including a silencer, such as a muffler.

2. Description of the Related Art

A silencer for a motorcycle reduces exhaust noise generated when exhaust gas flows from an engine. A motorcycle disclosed by JP 2007-91132 A includes a first muffler (silencer) and a second muffler. The first muffler is provided on a side of an oil pan for an engine. The second muffler is connected to the first muffler and provided behind the engine.

SUMMARY OF THE INVENTION

A vehicle, such as a motorcycle, according to embodiments of the present invention can include an engine, an exhaust pipe, and a silencer, such as a muffler. Exhaust gas from the engine can flow into the exhaust pipe. The silencer can discharge the exhaust gas flowing out of the exhaust pipe to the outside. The silencer can include a main body and first and second pipes. The main body can include an outer tube, an upstream lid provided at the upstream end of the outer tube, and a downstream lid provided at the downstream end of the outer tube. The first pipe can be disposed, e.g., inserted, in the main body, and have an upstream end and a downstream end. The exhaust gas from the exhaust pipe can flow into the upstream end. The downstream end can be provided in the main body. The second pipe can be provided apart, e.g., separated, from the first pipe on the downstream side of the first pipe, and coaxially, including, e.g., approximately or substantially coaxially, with the first pipe, and extend, e.g., penetrate, through the downstream lid. The downstream portion of the first pipe can have an inner diameter that decreases, e.g., gradually decreases, from the upstream side toward the downstream end. The upstream end of the second pipe can be provided in the main body and have a larger inner diameter than the inner diameter of the downstream end of the first pipe.

In the vehicle, e.g., motorcycle, according to the embodiments of the present invention, the second pipe in the silencer can be provided, as noted above, coaxially with the first pipe. Therefore, exhaust gas discharged from the first pipe can flow easily into the second pipe. Therefore, degradation in the output performance of the engine can be reduced. The inner diameter of the upstream end of the second pipe can be larger than the inner diameter of the downstream end of the first pipe. As a result, the flow of exhaust gas flowing into the second pipe from the first pipe can be prevented from being easily disturbed. Therefore, airflow noise in the silencer can be reduced, so that exhaust noise is reduced.

The main body can further include a first expansion chamber, a resonator, and a first partition plate. The first expansion chamber can be formed on the upstream side in the main body. The resonator can be formed on the downstream side of the first expansion chamber. The first partition plate can be provided in the main body on the downstream side of the downstream end of the first pipe. The first partition plate can have first and second through holes formed therein. The second pipe can extend through, e.g. be inserted in, the first through hole. The first expansion chamber and the resonator can communicate with, e.g., be communicated with, each other by the second through hole. The first expansion chamber and the resonator can be separated by the first partition plate.

The first expansion chamber and the resonator can be defined in the silencer by the first partition plate. Exhaust gas flowing into the first expansion chamber from the first pipe can expand in the first expansion chamber, thereby lowering the pressure of the exhaust gas. At this time, a pressure wave can be generated. The resonator can be formed on the downstream side of the downstream end of the first pipe. Therefore, the resonator can alleviate the pressure wave. As a result, exhaust noise can be reduced.

The vehicle, e.g., motorcycle, can further include a chamber. The chamber can include a plurality of expansion chambers. The exhaust pipe can include first and second exhaust pipes. The first exhaust pipe can be provided between the engine and the chamber. The second exhaust pipe can be provided between the chamber and the silencer. The chamber can include an enclosure, e.g., a box, a second expansion chamber, a third expansion chamber, a second partition plate, a first communicating pipe, and a second communicating pipe. The second expansion chamber can be formed in the box and communicate, e.g. be communicated, with the second exhaust pipe. The third expansion chamber can be formed further to a rear side of the vehicle, e.g., motorcycle, than the second expansion chamber. The second partition plate can be provided between the second expansion chamber and the third expansion chamber. The first communicating pipe can have an upstream end connected to the first exhaust pipe, and a downstream end provided in the third expansion chamber. The first communicating pipe can extend, e.g., penetrate, through the second expansion chamber and the second partition plate. The second communicating pipe can have an upstream end provided in the third expansion chamber and a downstream end provided in the second expansion chamber. The second communicating pipe can extend, e.g., penetrate, through the second partition plate.

In view of the structure described in the foregoing, the length of the pipes (the exhaust pipe and first and second communicating pipes) that guide exhaust gas from the engine to the silencer can be prolonged. Therefore, the engine performance can be improved.

A plurality of through holes can be provided at the circumferential surface of a downstream portion of the first pipe. In this way, the engine performance can be substantially maintained.

The silencer can further include an inner tube and a silencing material. The inner tube can be disposed, e.g., inserted, in the outer tube, and have a circumferential surface provided with a plurality of through holes. The silencing material can be disposed, e.g. filled, between the outer tube and the inner tube. In this way, exhaust noise can be reduced.

In view of the foregoing, embodiments of the present invention can further relate to an exhaust device that can comprise a chamber. A partition in the chamber can form a front enclosure and a rear enclosure. A first communicating pipe can extend from an upstream end of the chamber through the partition into the rear enclosure. A second communicating pipe can extend between the front enclosure and the rear enclosure. The exhaust device can further comprise a muffler connected to the chamber. The muffler can include a front pipe and a rear pipe separated from each other, the front pipe being coaxial with the rear pipe and tapering toward the rear pipe. An inner diameter of the rear pipe can be larger than an inner diameter of the front pipe at a rear portion of the front pipe. The muffler can further include a partition forming another enclosure, the front pipe and the rear pipe opening onto the other enclosure.

Other features, elements, steps, characteristics and advantages of the embodiments of the present invention will become more apparent from the following detailed description of exemplary embodiments of the present invention with reference to the attached drawings.

DETAILED DESCRIPTION OF THE INVENTION

The invention will now be described in more detail by way of example with reference to the embodiments shown in the accompanying Figures. It should be kept in mind that the following described embodiments are only presented by way of example and should not be construed as limiting the inventive concept to any particular physical configuration. It should further be understood that "exemplary" as used herein means "serving as an example, instance or illustration." Any aspect referred to herein as "exemplary" is not necessarily to be construed as preferred over other aspects.

Further, if used and unless otherwise stated, the terms "upper," "lower," "front," "back," "over," "under," and similar such terms are not to be construed as limiting the invention to a particular orientation. Instead, these terms are used only on a relative basis.

Moreover, any term of degree used herein, such as "substantially," "essentially," "nearly" and "approximately" means a reasonable amount of deviation of the modified word is contemplated such that the end result is not significantly changed. For example, such terms can be construed as allowing a deviation of at least 5% of the modified word if this deviation would not negate the meaning of the word the term of degree modifies.

Overall Structure of Motorcycle

Figure 1:
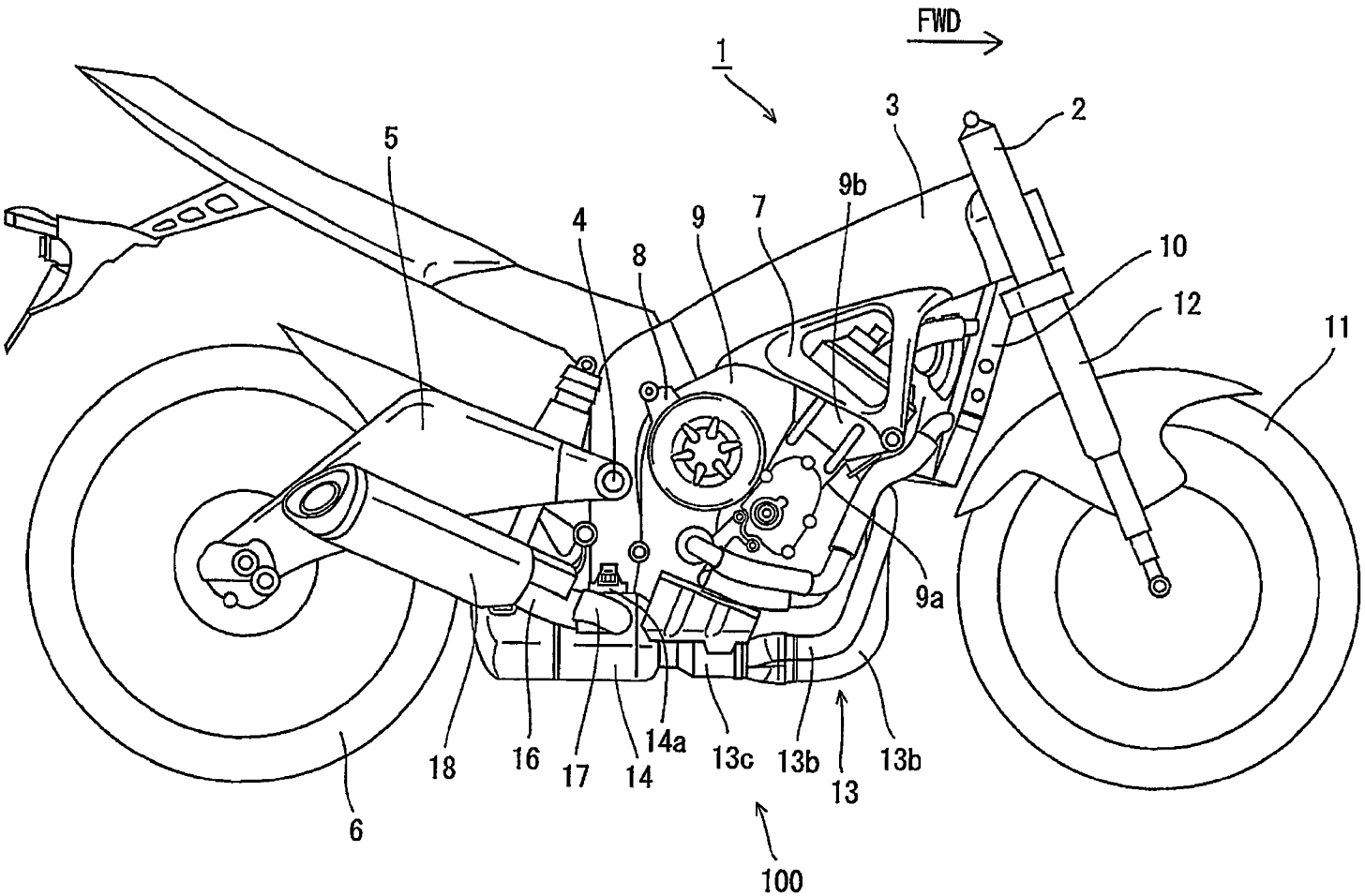
FIG. 1 is a side view of a motorcycle 1 according to an exemplary embodiment of the present invention.

FIG. 1 is a right side view of a motorcycle 1 according to an exemplary embodiment of the present invention. The following description may include references to directions, such as "front," "frontward," "ahead," "back," "rear," "rearward," "behind," "right," "left," "above," "below," "up," "upward," "down," "downward," "forward," "backward," "widthwise," "lengthwise," "longitudinal," "horizontal" and "vertical." As used herein (if used), these terms reflect the perspective of a person facing in the direction indicated by the arrow labeled "FWD" in the drawings, such as a rider seated on or straddling the motorcycle 1 and facing toward a front wheel 11. Thus, the arrow labeled "FWD" indicates a back-to-front direction relative to the motorcycle 1, or an advancing direction of the motorcycle 1. A direction specified as "left" or "right" in the description refers to left or right with respect to the FWD direction or a direction opposite (e.g. 180 degrees from) to the FWD direction. "Widthwise" corresponds to a direction substantially transverse to the FWD direction or to a direction opposite to the FWD direction, e.g., a left-to-right or right-to-left direction. "Lengthwise" (with respect to the motorcycle 1) or "longitudinal" corresponds substantially to the FWD direction or to a direction opposite to the FWD direction. "Vertical" refers to a direction substantially transverse to both the widthwise and lengthwise directions, and corresponds substantially to "upward" and/or "downward." "Horizontal" refers to a direction substantially transverse to the vertical direction, and corresponds substantially to the FWD direction or to a direction opposite to the FWD direction.

Referring to FIG. 1, the motorcycle 1 can include a head pipe 2, a main frame 3, and an engine 9.

The main frame 3 can extend obliquely downward from the head pipe 2 toward the rear side of the motorcycle 1. The head pipe 2 can be attached at the tip end of the main frame 3. A front frame portion 10 can be provided. A handle (not shown) can be provided above the head pipe 2. A pair of front forks 12 can be provided under the head pipe 2. A front wheel 11 can be attached rotatably at the lower end of the pair of front forks 12.

A pivot shaft 4 can be provided at the rear part of the main frame 3. A rear arm 5 can be supported at its front end so that it can swing in the vertical direction around the pivot shaft 4. A rear wheel 6 can be attached rotatably at the rear end of the rear arm 5.

The engine 9 can be provided under the main frame 3. Support plates 7 and 8 can be provided between the engine 9 and the main frame 3. The engine 9 can be attached to the main frame 3 by the support plates 7 and 8. The engine 9 can include four cylinders 9*a* and four cylinder heads 9*b*.

Exhaust Device 100

The motorcycle 1 can further include an exhaust device 100. The exhaust device 100 can include exhaust pipes 13 and 16, a chamber 14, and a silencer 18. The exhaust pipe 13 can be provided between the engine 9 and the chamber 14. Exhaust gas from the engine 9 can flow into the exhaust pipe 13. The exhaust pipe 16 can be provided between the chamber 14 and the silencer 18.

Exhaust Pipe 13

Figure 2:
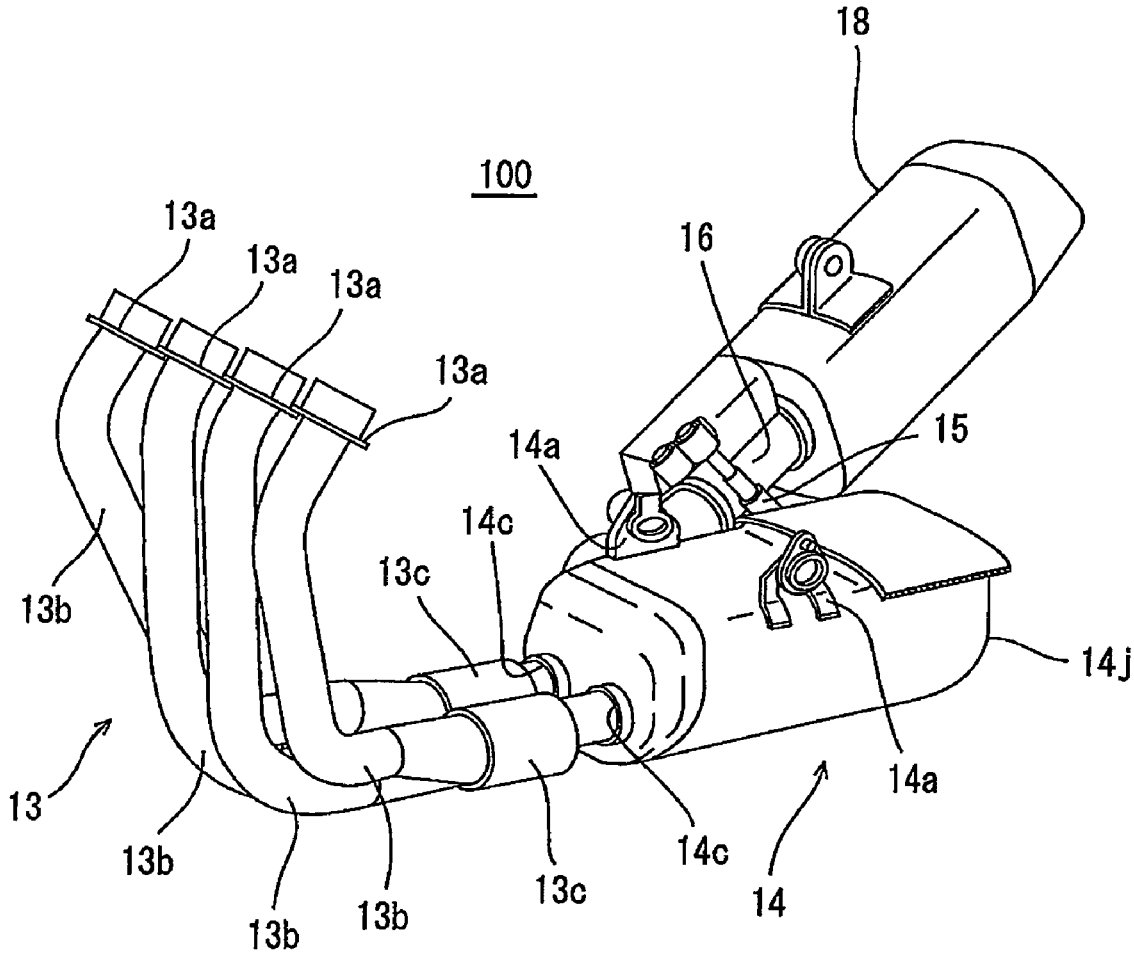
FIG. 2 is a perspective view of an exhaust device shown in FIG. 1.

FIG. 2 is a perspective view of the exhaust device 100. Referring to FIG. 2, the exhaust pipe 13 can include a plurality of exhaust pipes 13*b*, a plurality of flanges 13*a*, and a plurality of exhaust pipes 13*c*. The upstream end (end on the upstream side) of each of the exhaust pipes 13*b* can be provided with a flange 13*a*. The upstream end of each of the exhaust pipes 13*b* can be connected to a corresponding cylinder head 9*b* through a flange 13*a*. Referring to FIGS. 1 and 2, the exhaust pipes 13*b* can extend downward from the cylinder head 9*b*. The rear part of the exhaust pipes 13*b* can extend downward from the cylinder head 9. The rear part of the exhaust pipe 13*b* can be bent toward the back of the motorcycle 1. Therefore, the downstream end (end on the downstream side) of the exhaust pipe 13*b* can be directed to the back of the motorcycle 1.

Figure 3:
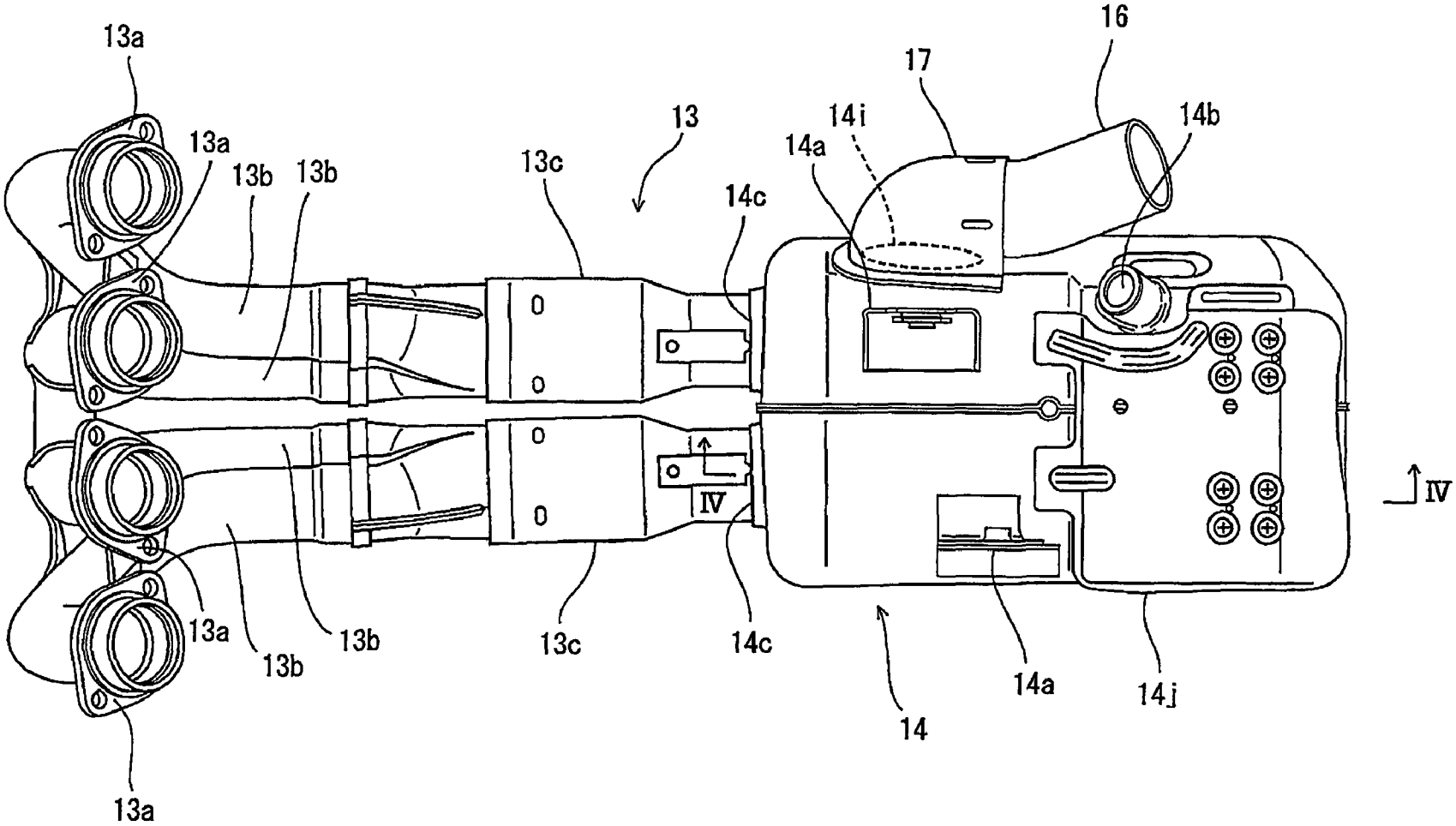
FIG. 3 is a plan view of the exhaust device shown in FIG. 1.

FIG. 3 is a plan view of the exhaust device 100. Referring to FIGS. 2 and 3, the upstream end of one exhaust pipe 13*c* can be connected to the downstream ends of the two exhaust pipes 13*b*. The upstream end of the other exhaust pipe 13*c* can be connected to the downstream ends of the remaining two exhaust pipes 13*b*.

Chamber 14

Referring to FIG. 1, the chamber 14 can be attached at the lower end of the main frame 3 by a stay 14*a*. As shown in FIG. 2, the chamber 14 can include an enclosure, e.g., a box, 14*j*. Two openings 14*c* can be formed at the front surface of the box 14*j*. The openings 14*c* can each be connected to the downstream end of a corresponding exhaust pipe 13*c*.

Referring to FIG. 3, the chamber 14 can further have formed therein an opening 14*i* at a side surface. The exhaust pipe 16 can be connected to the opening 14*i* with a pipe cover 17. Exhaust gas can be let out from the exhaust pipe 13 into the chamber 14, and flow into the exhaust pipe 16 from the chamber 14. The silencer 18 (see, e.g., FIG. 2) can be connected to the downstream end of the exhaust pipe 16, and the exhaust gas can flow out of the exhaust pipe 16 to the silencer 18. An opening 14*b* can be formed on the upper surface of the rear part of the box 14*j*. As shown in FIG. 2, the opening 14*b* tan have an oxygen sensor 15 disposed, e.g., inserted, therein. The oxygen sensor 15 can measure the oxygen concentration in the chamber 14.

Figure 4:
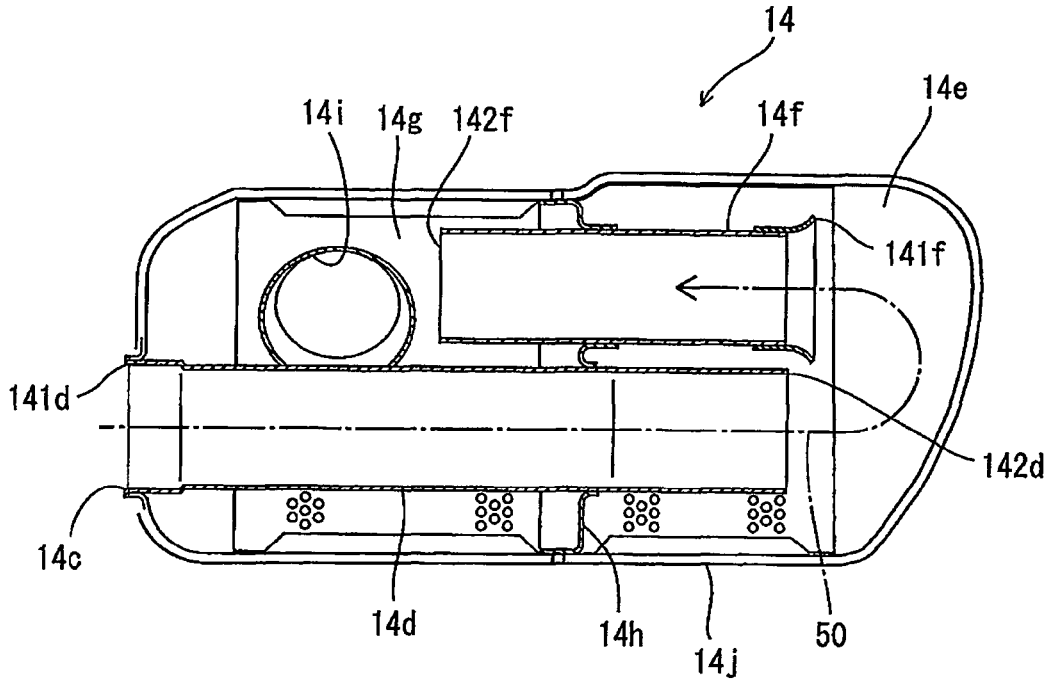
FIG. 4 is a sectional view taken along line IV-IV in FIG. 3.

FIG. 4 is a sectional view taken along line IV-IV in FIG. 3. Referring to FIG. 4, the chamber 14 can further include expansion chambers 14*e* and 14*g*, a partition plate 14*h*, and communicating pipes 14*d* and 14*f*. The expansion chamber 14*g* can be formed in the box 14*j*. The expansion chamber 14*g* can communicate, e.g., be communicated with, the exhaust pipe 16 by way of the opening 14*i* into the pipe cover 17. The expansion chamber 14*e* can be formed in the box 14*j* further to the rear than the expansion chamber 14*g*. The partition plate 14*h* can be provided between the expansion chambers 14*g* and 14*e*. More specifically, the expansion chambers 14*g* and 14*e* can be separated by the partition plate 14*h*.

Figure 5:
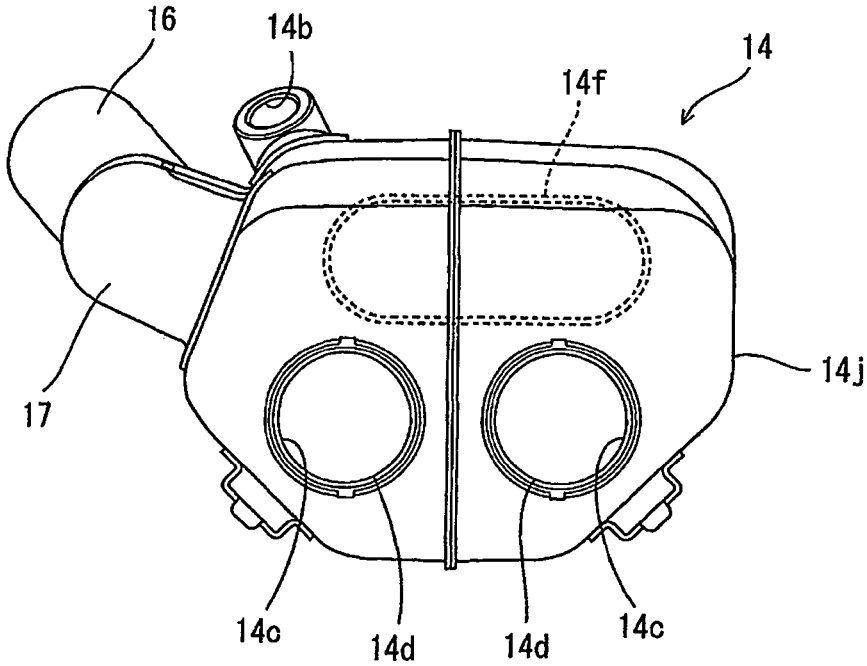
FIG. 5 is a front view of a chamber shown in FIG. 3.

The communicating pipe 14*d* can be disposed in, e.g., inserted into, the box 14*j* from the opening 14*c* and extend, e.g., penetrate, through the expansion chamber 14*g* and the partition plate 14*h*. The communicating pipe 14*d* can be a substantially linear cylindrical pipe and extend in the front-back direction of the motorcycle 1. The communicating pipe 14*d* can have an upstream end 141*d* and a downstream end 142*d*. The upstream end 141*d* can be connected to the exhaust pipe 13*c*. The downstream end 142*d* is provided in the expansion chamber 14*e*. FIG. 5 is a front view of the chamber 14. Referring to FIG. 5, two communicating pipes 14*d* are provided in this example. Each of the communicating pipes 14*d* can be connected to a corresponding exhaust pipe 13*c* (see, e.g., FIG. 3).

Referring to FIG. 5, the communicating pipe 14*f* can be provided above the two communicating pipes 14*d*. The communicating pipe 14*f* can have a substantially rectangular cross-sectional shape with rounded corners, e.g., an oblong or flattened ellipse. Referring to FIG. 4, the communicating pipe 14*f* can extend substantially linearly in the front-back direction of the motorcycle, and pass through the partition plate 14*h*. The communicating pipe 14*f* can have an upstream end 141*f* and a downstream end 142*f*. The upstream end 141*f* can be provided in the expansion chamber 14*e*. The downstream end 142*f* can be provided in the expansion chamber 14*g*.

Figure 6:
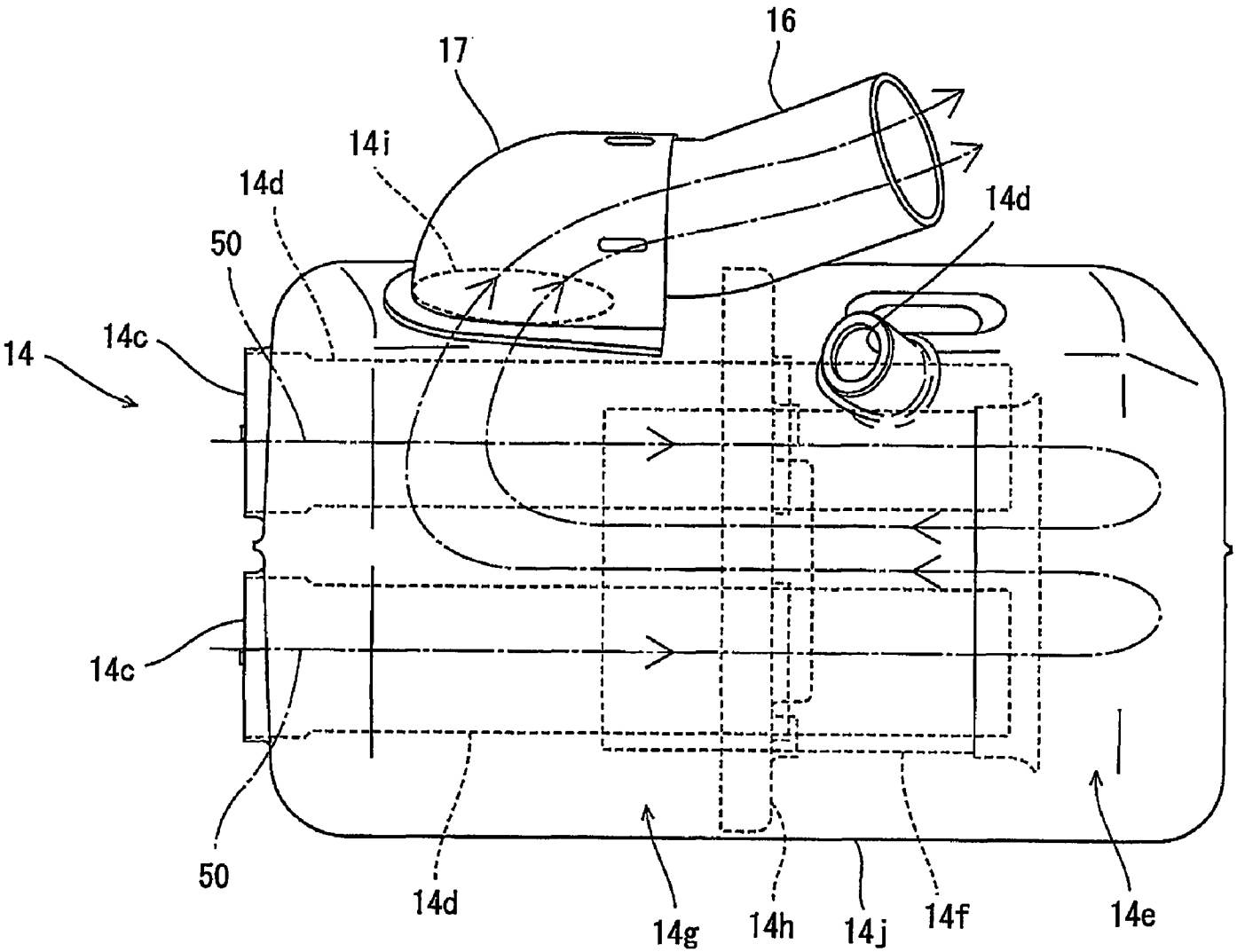
FIG. 6 is a plan view of the chamber shown in FIG. 3.

FIG. 6 is a plan view of the chamber 14. The single-dotted chain line 50 in FIG. 6 indicates the flow of exhaust gas in the chamber 14. Referring to FIG. 6, the exhaust gas can flow into the communicating pipe 14*d* from the opening 14*c*. The exhaust gas can flow through the communicating chamber 14*d* and flow into the expansion chamber 14*e* in the back part of the box 14*j*. The exhaust gas can expand in the expansion chamber 14*e* and the pressure of the exhaust gas can be reduced. Then, the exhaust gas can flow into the communicating pipe 14*f* from the expansion chamber 14*e*. The exhaust gas can pass through the communicating pipe 14*f* and flow into the expansion chamber 14*g*. The exhaust gas can expand in the expansion chamber 14*g* and the pressure of the exhaust gas can be reduced.

In short, the exhaust gas can expand stepwise in the expansion chambers 14*e* and 14*g*. Therefore, a pressure wave that could be caused by abrupt expansion of the exhaust gas can be alleviated. As a result, exhaust noise attributable to such a pressure wave (particularly exhaust noise including intermediate to high frequency components) can be reduced.

In the chamber 14, the downstream end 142*d* of the communicating pipe 14*d* can be provided in the expansion chamber 14*e* further to the rear than the expansion chamber 14*g*, and not in the expansion chamber 14*g*. In this way, the exhaust gas can flow into the expansion chamber 14*e* in the back part of the box 14*j* before flowing into the expansion chamber 14*g* in the front part of the box 14*j*. In this case, the communicating pipe 14*d* can be designed to have a large length. Therefore, the total length of the exhaust pipes 13 and 16 and the communicating pipes 14*d* and 14*g* that pass the exhaust gas can be increased. Therefore, the cycle of the pressure wave can be increased, so that the engine performance (power and torque), particularly at intermediate and low speeds, can improve.

The exhaust gas in the expansion chamber 14*g* can flow into the exhaust pipe 16 through the opening 14*i*. The exhaust gas in the exhaust pipe 16 can flow into the silencer 18.

Structure of Silencer 18

The silencer 18 can discharge the exhaust gas flowing out of the exhaust pipe 16 to the outside. The silencer 18 can also reduce exhaust noise generated when the exhaust gas flows out.

Figure 7:
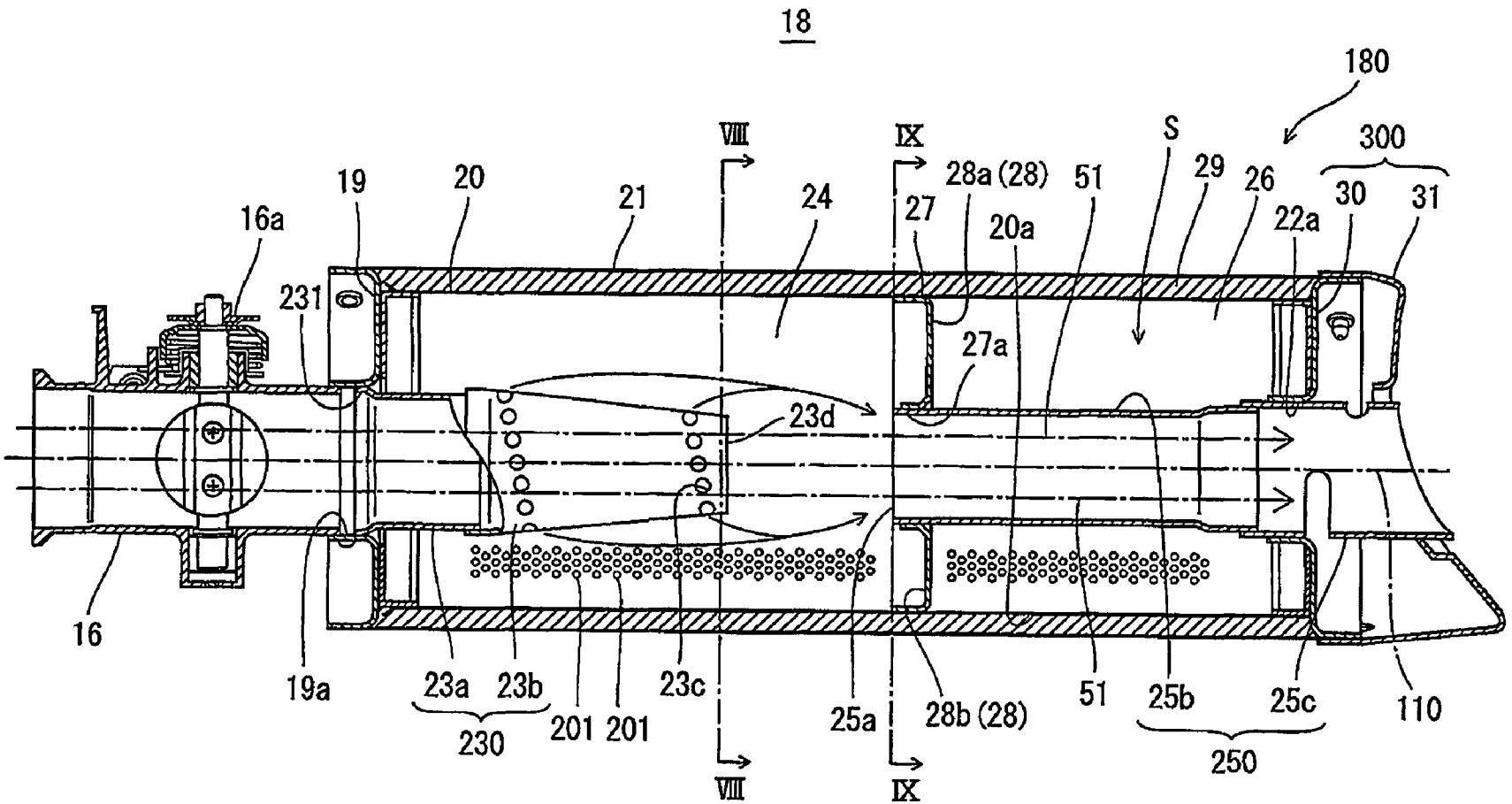
FIG. 7 is a longitudinal sectional view of a silencer shown in FIG. 2.

FIG. 7 is a longitudinal sectional view of the silencer 18 in FIG. 1. Referring to FIG. 7, the silencer 18 can include a main body 180. The main body 180 can include an outer tube 21 including a portion 21*a*, an upstream lid 19, and a downstream lid 300. The upstream lid 19 can be provided on the upstream end of the outer tube 21 and fitted into the upstream end opening. The downstream lid 300 can be provided at the downstream end of the outer tube 21. The downstream lid 300 can include a rear cap 30 and a tail cap 31. The rear cap 30 can be substantially disk-shaped and fitted into the downstream opening of the outer tube 21. The tail cap 31 can be formed as a recessed lid, with the downstream end of the outer tube 21 disposed, e.g., inserted, therein.

The main body 180 can further include an inner tube 20 comprising a surface 20*a*. The inner tube 20 can be disposed in, e.g. inserted into, the outer tube 21. A plurality of through holes 201 can be formed at the circumferential surface of the inner tube 20. The gap between the outer tube 21 and the inner tube 22 can have disposed therein, e.g. be filled with, a silencing material 29. The silencing material 29 can include, for example, glass wool. The silencing material 29 can alleviate a pressure wave attributable to exhaust gas and reduce exhaust noise. The silencing material 29 can, in particular, reduce the high frequency component of the exhaust noise.

The main body 180 can further include an expansion chamber 24 and a resonator 26. The expansion chamber 24 can be provided on the upstream side in the main body 180. The resonator 26 can be provided on the downstream side of the expansion chamber 24. A partition plate 27 can be provided between the expansion chamber 24 and the resonator 26. The expansion chamber 24 and the resonator 26 can be separated by the partition plate 27.

The silencer 18 can further include pipes 230 and 250. The pipe 230 can be disposed in, e.g. inserted into, the main body 180 through the upstream lid 19. The upstream lid 19 can have formed therein a through hole 19*a* and the upstream end 231 of the pipe 230 can be fitted into the through hole 19*a*. The pipe 230 can be connected to the exhaust pipe 16 through the upstream lid 19. A valve 16*a* can be provided on the downstream end of the exhaust pipe 16. The valve 16*a* can be used to regulate the amount of exhaust gas allowed to flow from the exhaust pipe 16 to the silencer 18.

The pipe 230 can extend substantially linearly in the longitudinal direction of the main body 180. The pipe 230 can have a substantially circular cross-sectional shape. The pipe 230 can include an upstream portion 23*a* and a downstream portion 23*b*. The downstream portion 23*b* can include an upstream end and a downstream end 23*d*. The upstream end of the downstream portion 23*b* is coupled to the downstream end of the upstream portion 23*a*. The downstream portion 23*b* can have a tapered shape. More specifically, the downstream portion 23*b* can have inner and outer diameters that decrease, e.g., gradually decrease, from the upstream side to the downstream end 23*d*. A plurality of through holes 23*c* can be formed at the circumferential surface of the downstream portion 23*b*.

The pipe 250 can be provided on the downstream side of the pipe 230 and apart from the pipe 230. The pipe 250 can be provided coaxially with the pipe 230 (on, e.g., an axis 110). The pipe 250 can have a linear shape and include an upstream portion 25*b* and a downstream portion 25*c*. The upstream portion 25*b* can be disposed in, e.g., inserted into, the upstream end of the downstream portion 25*c*. The downstream portion 25*c* can include a surface 22*a*. The pipe 250 can pass through the downstream lid 300. The upstream end 25*a* of the pipe 250 can be disposed in, e.g., inserted into, the through hole 27*a* formed at the partition plate 27.

As described above, the pipe 250 can be provided coaxially with the pipe 230. The single-dotted chain line 51 in FIG. 7 indicates the flow of exhaust gas flowing out of the pipe 230 to the pipe 250. The exhaust gas discharged from the pipe 230 can advance in a substantially axial direction, e.g., straight or directly, and enter the pipe 250. Therefore, exhaust resistance can be reduced, which can reduce degradation in engine efficiency (power and torque).

The opening area of the upstream end 25*a* of the pipe 250 can be substantially equal to the sum of the opening area of the plurality of through holes 23*c* of the downstream portion 23*b* and the opening area of the downstream end 23*d*. In this case, the flow rate per unit time of exhaust gas discharged from the downstream portion 23*b* can be substantially equal to the flow rate per unit time of exhaust gas flowing into the pipe 250. Therefore, the engine performance can be prevented from being lowered.

Figure 8:
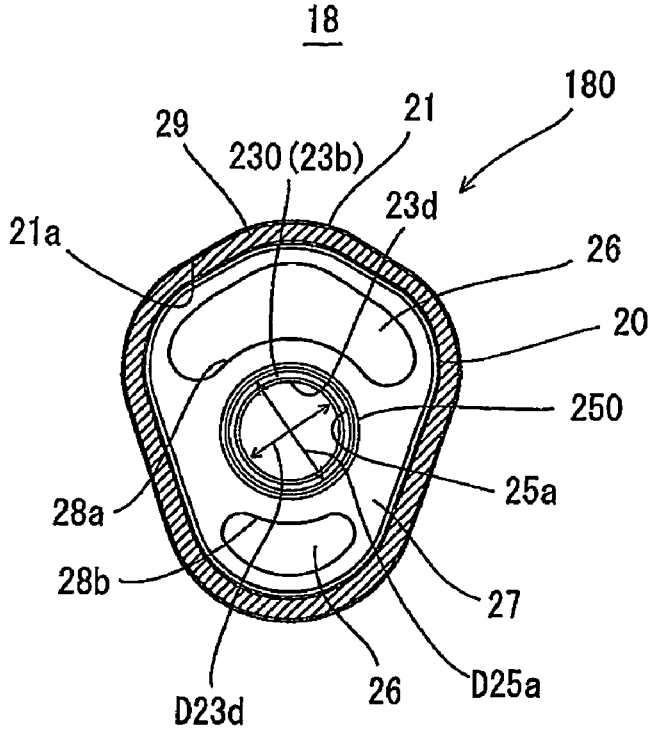
FIG. 8 is a sectional view taken along line VIII-VIII in FIG. 7.

FIG. 8 is a sectional view taken along line VIII-VIII in FIG. 7. Referring to FIG. 8, the inner diameter D25*a* of the upstream end 25*a* of the pipe 250 can be larger than the inner diameter D23*d* of the downstream end 23*d* of the pipe 230. If the inner diameter 25*a* were instead to be smaller than the inner diameter D23*d*, the flow of exhaust gas flowing into the upstream end 25*a* from the downstream end 23*d* would be disturbed, and a turbulent flow would be generated near the circumferential edge of the upstream end 25*a*. Such a turbulent flow of the exhaust gas would generate airflow noise, particularly causing exhaust noise at high frequencies (400 Hz or higher).

However, in the silencer 18 according to the exemplary embodiment, the inner diameter D25*a* can be larger than the inner diameter D23*a*. Therefore, the flow of exhaust gas flowing into the upstream end 25*a* from the downstream end 23*d* can be substantially undisturbed, and a turbulent flow can be substantially prevented. As a result, airflow noise can be substantially reduced or prevented, and high frequency exhaust noise can be substantially prevented.

Structure of Expansion Chamber 24

Referring to FIG. 7, the expansion chamber 24 can be provided on the upstream side in the main body 180. More specifically, the expansion chamber 24 can be formed between the upstream lid 19 and the partition plate 27 in the main body 180. Therefore, the expansion chamber 24 can entirely surround the outer circumferential side of the downstream portion 23*b* of the pipe 230 and the opening side of the downstream end 23*d* in the main body 180. The exhaust gas in the pipe 230 can flow out of the through holes 23*c* and the downstream end 23*d* to the expansion chamber 24. In this way, the exhaust gas can expand and the pressure of the exhaust gas can be reduced.

Structure of Partition Plate 27 and Resonator 26

Figure 9:
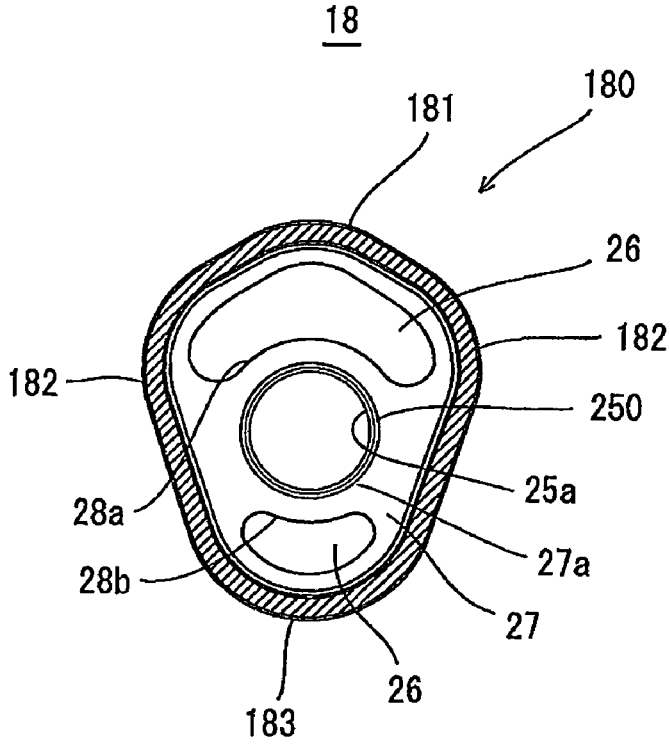
FIG. 9 is a sectional view taken along line IX-IX in FIG. 7.

The resonator 26 can be provided on the downstream side of the expansion chamber 24. More specifically, it can be formed between the partition plate 27 and the downstream lid 300 in the main body 180. FIG. 9 is a sectional view taken along line IX-IX in FIG. 7. Referring to FIG. 9, the partition plate 27 can have formed therein a through hole 27*a* and through holes 28*a* and 28*b*. The pipe 250 can be disposed, e.g. inserted, in the through hole 27*a*. The through holes 28*a* and 28*b* can communicate, e.g. enable communication between, the expansion chamber 24 and the resonator 26.

When exhaust gas flows out of the pipe 230 to the expansion chamber 24, a pressure wave can be generated in response to the expansion of the exhaust gas. The resonator 26 can be provided on the downstream side of the expansion chamber 24. The pressure wave can pass through the through holes 28*a* and 28*b* and advance to the resonator 26. The resonator 26 can alleviate the pressure wave and reduce the exhaust noise. The resonator 26, in particular, can reduce exhaust noise generated when the engine speed is in the intermediate speed range and high speed range. The frequency component of exhaust noise that can be reduced can be adjusted according to the capacity S of the resonator 26, the opening area of the through holes 28*a* and 28*b*, and the thickness of the partition plate 27.

Cross-Sectional Shape of Silencer 18

As shown in FIG. 9, in a cross section thereof the silencer 18 can be substantially egg-shaped, e.g. ovoid or oblong. The main body 180 of the silencer 18 can include an upper surface 181, a pair of side surfaces 182, and a bottom surface 183. The upper surface 181 has an arched cross sectional shape that is curved upward as shown in FIG. 9. The distance between the side surfaces 182 can decrease, e.g., gradually decrease, from the upper surface 181 toward the bottom surface 183. In other words, the width of the silencer 18 can be narrowed gradually from the upper surface 181 toward the bottom surface 183. The bottom surface 183 can merge with, meet or be connected to the pair of side surfaces 182. The bottom surface 183 can be substantially arch-shaped and curved downward.

Figure 10:
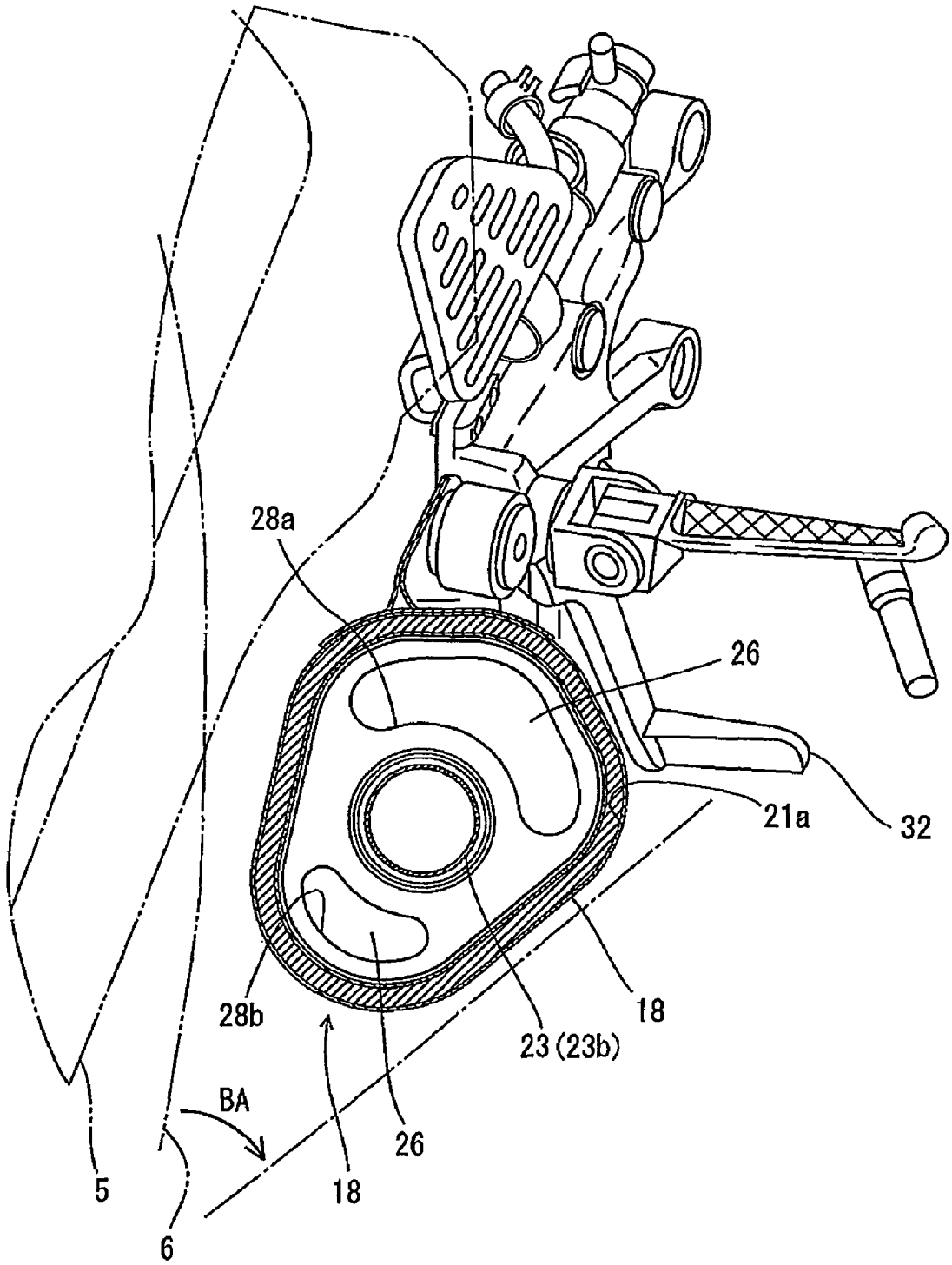
FIG. 10 is a schematic view for illustrating the relation between a silencer and a bank angle.

As shown in FIG. 1, in general, the silencer 18 can be provided on the right side of the motorcycle 1. FIG. 10 is a schematic view of the vicinity of the silencer 18 of the motorcycle 1. Referring to FIG. 10, a brake pedal 32 can be provided in the lower part of the right side surface of the motorcycle 1. The arrangement of the brake pedal 32 can determine the bank angle BA of the motorcycle 1. The silencer 18 can have a substantially egg-shaped cross section, as noted previously. Therefore, the bank angle of the motorcycle 1 can be kept from being reduced while preventing the silencer 18 from interfering with the rear wheel 6.

In view of the foregoing description, embodiments of the present invention can further relate to an exhaust device 100 that can comprise a chamber 14. A partition 14*h* in the chamber 14 can form a front enclosure 14*g* and a rear enclosure 14*e*. A first communicating pipe 14*d* can extend from an upstream end of the chamber 14 through the partition 14*h* into the rear enclosure 14*e*. A second communicating pipe 14*f* can extend between the front enclosure 14*g* and the rear enclosure 14*e*. The exhaust device 100 can further comprise a muffler 18 connected to the chamber 14. The muffler 18 can include a front pipe 230 and a rear pipe 250 separated from each other, the front pipe 230 being coaxial with the rear pipe 250 and tapering toward the rear pipe 250. An inner diameter D25*a* of the rear pipe 250 can be larger than an inner diameter D23*d* of the front pipe 230 at a rear portion of the front pipe 230. The muffler 18 can further include a partition 27 forming another enclosure 24, the front pipe 230 and the rear pipe 250 opening onto the other enclosure 24.

Operation of Exhaust Device 100

The exhaust device 100 can reduce exhaust noise and reduce degradation in the engine performance (e.g., power and torque). Now, the operation of the exhaust device 100 will be described in detail. Exhaust gas in the engine 9 in FIG. 1 can flow into the chamber 14 through the exhaust pipe 13. Referring to FIG. 4, the exhaust gas can flow into the expansion chamber 14*e* through the communicating pipe 14*d* in the chamber 14. The exhaust gas can expand in the expansion chamber 14*e* and the pressure of the exhaust gas can be lowered. The exhaust gas in the expansion chamber 14*e* can flow into the expansion chamber 14*g* through the communicating pipe 14*f*. The exhaust gas can expand again in the expansion chamber 14*g* and the pressure of the exhaust gas can be lowered. The exhaust gas in the expansion chamber 14*g* can flow into the exhaust pipe 16 through the opening 14*i*. Referring to FIG. 7, the exhaust gas in the exhaust pipe 16 can flow into the silencer 18. The exhaust gas can flow into the expansion chamber 24 through the pipe 230 in the silencer 18. The exhaust gas can expand again in the expansion chamber 24 and the pressure of the exhaust gas can be lowered.

As described in the foregoing, the exhaust gas can expand stepwise in the expansion chambers 14*e*, 14*g*, and 24. Therefore, the pressure of the exhaust gas can be reduced stepwise to the level of the atmospheric pressure. In this way, the exhaust gas can be prevented from abruptly expanding. Exhaust noise can be thus reduced. Furthermore, a pressure wave generated by the expansion of the exhaust gas in the expansion chamber 24 can be alleviated by the resonator 26 and the silencing material 29. By the above-described operation, exhaust noise can be reduced. High frequency exhaust noise, in particular, can be reduced.

The exhaust device 100 can also reduce degradation in the engine performance. As shown in FIG. 7, the pipe 250 in the silencer 18 can be provided coaxially with the pipe 230. Therefore, exhaust gas discharged from the pipe 230 can advance substantially directly, e.g., straight, into the pipe 250. When the exhaust gas flows into the pipe 250 from the pipe 230, generating a large resistance can be prevented. Therefore, the degradation in the engine performance can be reduced.

As described previously, the inner diameter D25*a* of the upstream end 25*a* of the pipe 250 can be larger than the inner diameter D23*d* of the downstream end 23*d* of the pipe 230. Therefore, the flow of the exhaust gas flowing into the upstream end 25*a* from the downstream end 23 can be substantially undisturbed and airflow noise can be substantially reduced or prevented.

By the above-described operation, the exhaust device 100 can reduce exhaust noise while reducing degradation in the engine performance.

Other Exemplary Embodiments

In the above-described exemplary embodiment, the partition plate 27 can be provided in the main body 180 of the silencer 18. However, alternatively, the partition plate 27 need not be provided. In this case, the structure of the silencer can be the same as that of the silencer 18 except for the absence of the partition plate. In this arrangement, a single expansion chamber can be formed in the main body 180 of the silencer. Therefore, the silencer without the partition plate 27 can reduce exhaust noise and reduce degradation in the engine performance.

Moreover, the through holes 23*c* need not be formed in the downstream portion 23*b* of the pipe 230 in the silencer 18. The silencer according to such an arrangement still reduces airflow noise and exhaust noise, and the degradation in the engine performance is still reduced.

First Comparative Example

Figure 11:
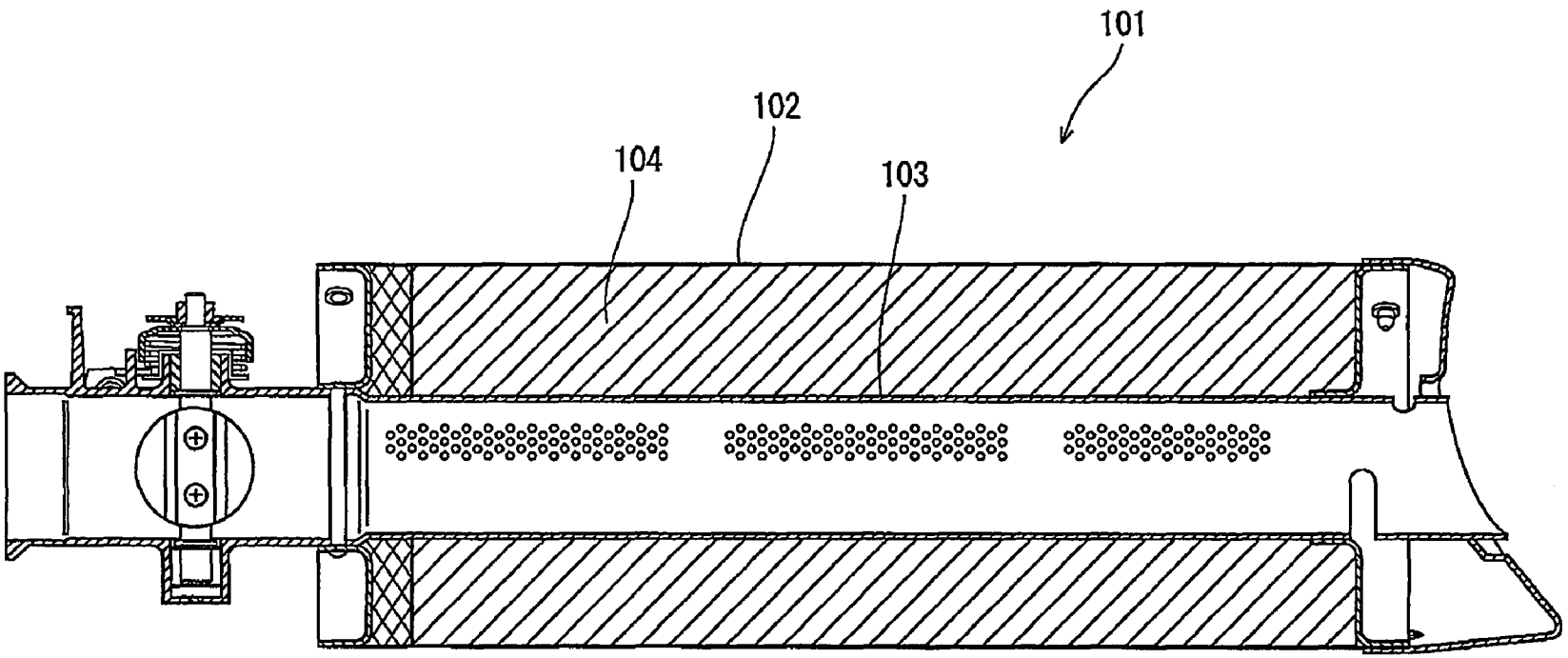
FIG. 11 is a sectional view of a silencer in a first comparative example.

To demonstrate advantages of embodiments according to the present invention, the silencer 18 according to the above-described exemplary embodiment, having the structure shown in FIG. 7, and a silencer 101 according to a first comparative example (hereafter, "comparative example 1") having the structure shown in FIG. 11 were prepared, and a comparison was made therebetween. Referring to FIG. 11, the silencer 101 included an upstream lid, an outer tube 102, a downstream lid, a pipe 103, and a silencing material 104. The pipe 103 was passed through the upstream and downstream lids and inserted into the outer tube 102. The gap between the outer tube 102 and the pipe 103 was filled with a silencing material 104. The silencing material 29 for the silencer 18 and the silencing material 104 was glass wool.

The level of the exhaust noise was measured in the exemplary embodiment (corresponding to silencer 18, hereafter, "inventive example") and the comparative example 1 (corresponding to silencer 101). More specifically, an exhaust device including the silencer 18 and an exhaust device including the silencer 101 were prepared. In the comparison, structures were substantially the same except for the silencers. The prepared exhaust devices were each connected to an engine and measured for exhaust noise.

Figure 12:
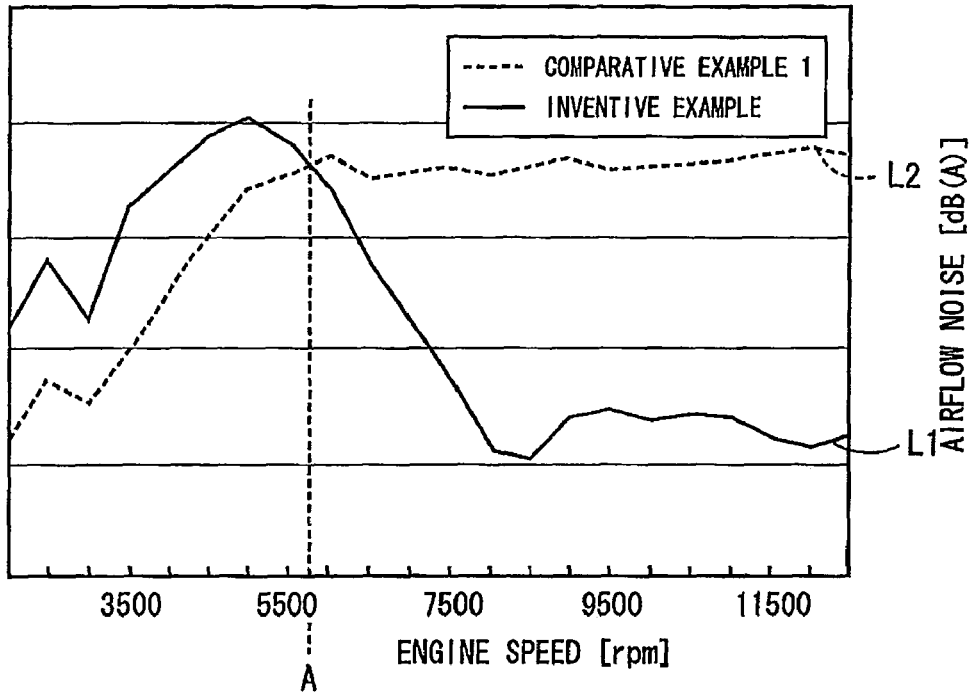
FIG. 12 is a graph showing the relation between the engine speed and the exhaust noise.

FIG. 12 is a graph showing the relation between the engine speed and the exhaust noise. The abscissa in FIG. 12 indicates the engine speed (rpm). The ordinate indicates the exhaust noise (dB). The solid line L1 in FIG. 12 indicates the exhaust noise in the inventive example. The broken line L2 indicates the exhaust noise in the comparative example 1. Referring to FIG. 12, when the engine speed was not less than the intermediate speed range, more specifically when the engine speed was not less than 5800 rpm (not less than the speed A in FIG. 12), the exhaust noise in the inventive example was lower than that in the comparative example 1.

Figure 13:
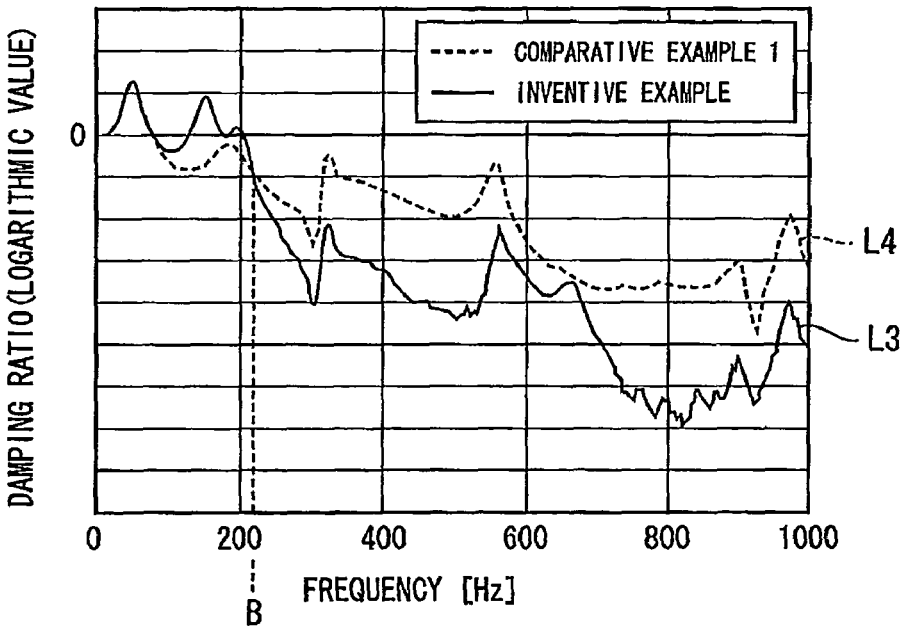
FIG. 13 is a graph showing the damping characteristic of exhaust noise in an example according to embodiments of the present invention, and the first comparative example.

FIG. 13 is a graph showing the amount of exhaust noise for each frequency component in the inventive example and the comparative example 1. The abscissa in FIG. 13 indicates the frequency (Hz) of exhaust noise. The ordinate in FIG. 13 indicates the damping ratio (logarithmic value). The damping ratio for each frequency was obtained by the following Expression (1):

Damping ratio=the exhaust noise amount in the inventive example or the comparative example 1/the exhaust noise amount in an exhaust device without a silencer (1)

In short, at each frequency, the ratio of the exhaust noise amount in the inventive example or the comparative example 1 relative to the exhaust noise amount without the silencer was defined as the damping ratio for the frequency.

The solid line L3 in FIG. 13 indicates the damping ratio in the inventive example, and the broken line L4 indicates the damping ratio in the comparative example 1. Referring to FIG. 13, the damping ratio in the inventive example (L3) was smaller than that in comparative example 1 (L4) at frequencies equal to or higher than 220 Hz (the frequency B in FIG. 13). More specifically, in the inventive example, the exhaust noise of the frequency components equal to or higher than 220 Hz (intermediate and high frequencies) was reduced. In general, as the engine speed increases, more high frequency exhaust noise is generated. In the inventive example, the exhaust noise having a frequency equal to or higher than the intermediate frequency can be reduced. Consequently, in the inventive example, when the engine speed is in the intermediate speed range (about 6000 rpm) or higher, exhaust noise can be reduced effectively.

Second Comparative Example

Figure 14:
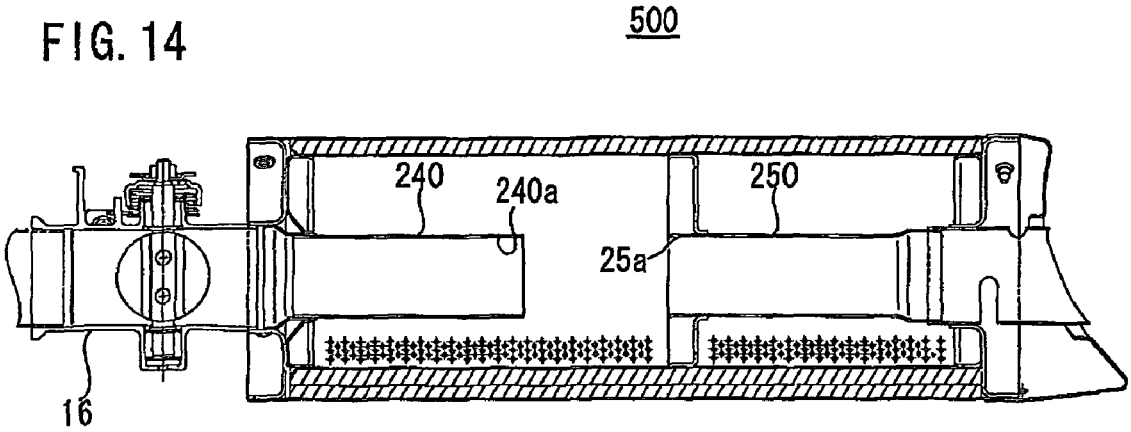
FIG. 14 is a sectional view of a silencer in a second comparative example.

Along previous lines, a silencer 18 as in the above-described inventive example and a silencer 500 according to a second comparative example (hereafter, "comparative example 2") shown in FIG. 14 were prepared, and a comparison was made between them. Referring to FIG. 14, the silencer 500 was different from the silencer 18 in that it included a pipe 240 instead of the pipe 230. The pipe 240 had fixed outer and inner diameters and did not have the downstream part 23*b* whose inner diameter gradually decreased like the pipe 230. The inner diameter of the downstream end 240*a* of the pipe 240 was the same as the inner diameter of the upstream end 25*a* of the pipe 250. The length of the pipe 240 was the same as the length of the pipe 230. Other structures of the silencer 500 were substantially the same as that of the silencer 18.

Figure 15:
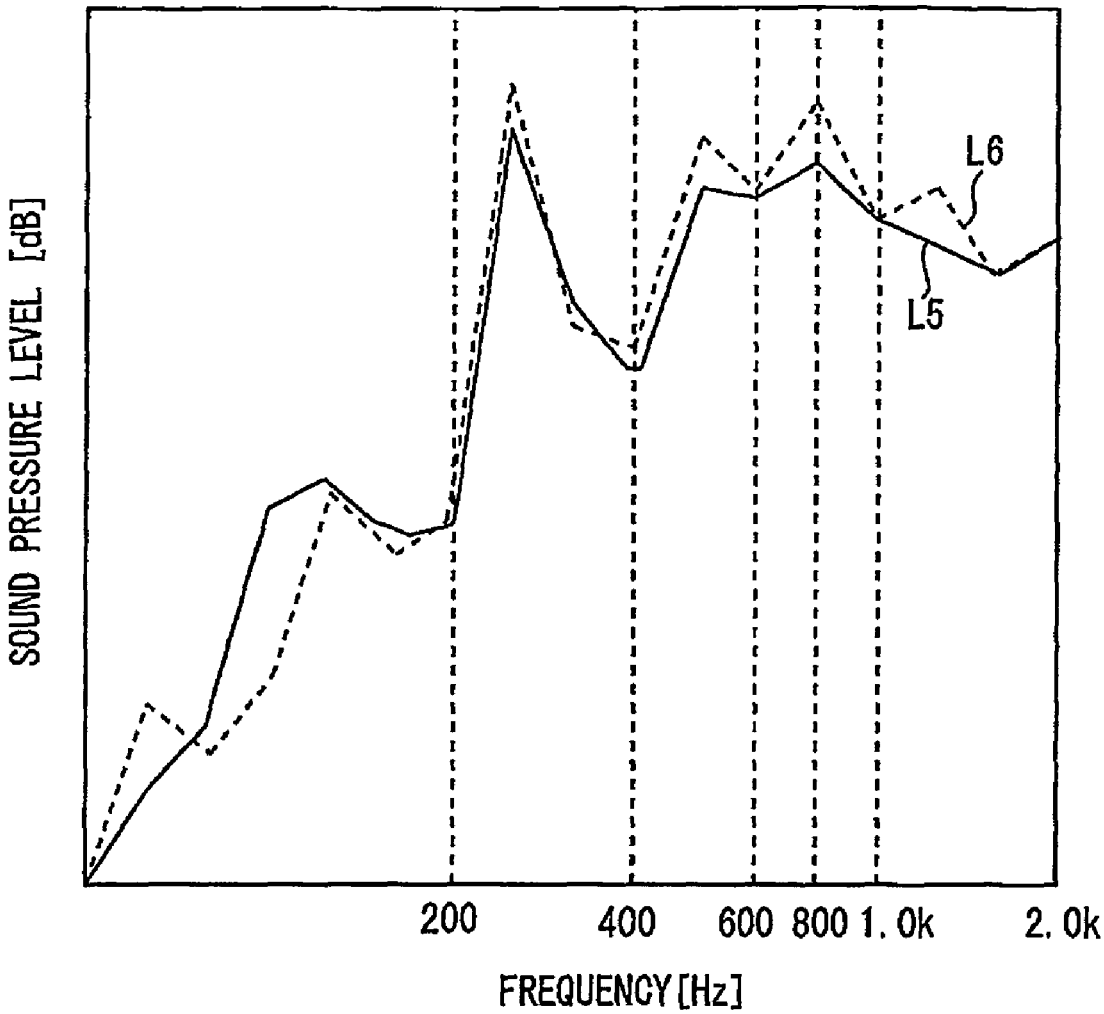
FIG. 15 is a graph showing the sound pressure level of exhaust noise relative to frequencies in an example according to embodiments of the present invention, and the second comparative example.

Similarly to the first comparative example, the present inventive example (corresponding to silencer 18) and the comparative example 2 (corresponding to silencer 500) were measured for the levels of exhaust noise, and the result is given in FIG. 15. The measuring method was the same as used in comparative example 1.

FIG. 15 is a graph showing the sound pressure level of exhaust noise for each frequency in the present inventive example and the comparative example 2. The abscissa in FIG. 15 represents the frequency (Hz) of the exhaust noise. The ordinate represents the sound pressure level (dB). The solid line L5 in FIG. 15 indicates the sound pressure level in the present inventive example and the broken line L6 indicates the sound pressure level in the comparative example 2. Referring to FIG. 15, the sound pressure level of the exhaust noise at frequencies of 400 Hz or higher was lower in the present inventive example than in the comparative example 2. It is believed that this is at least partly because in the comparative example 2, the flow of exhaust gas flowing into the upstream end 25*a* of the pipe 250 from the downstream end 240*a* of the pipe 240 was disturbed, and the sound pressure level at frequencies of 400 Hz or higher was higher than in the present inventive example.

It will be apparent to one skilled in the art that the manner of making and using the claimed invention has been adequately disclosed in the above-written description of the exemplary embodiments taken together with the drawings. Furthermore, the foregoing description of the embodiments according to the invention is provided for illustration only, and not for limiting the invention as defined by the appended claims and their equivalents.

It will be understood that the above description of the exemplary embodiments of the invention are susceptible to various modifications, changes and adaptations, and the same are intended to be comprehended within the meaning and range of equivalents of the appended claims.

What is claimed is:

1. A motorcycle, comprising:

an engine;

an exhaust pipe into which exhaust gas from the engine flows; and a silencer that discharges the exhaust gas flowing out of the exhaust pipe, the silencer comprising a main body including an outer tube, an upstream lid provided at an upstream end of the outer tube, and a downstream lid provided at a downstream end of the outer tube, a first pipe inserted in the main body through the upstream lid and having an upstream end into which exhaust gas from the exhaust pipe flows and a downstream end provided in the main body, and a second pipe provided apart from the first pipe on a downstream side of the first pipe and approximately coaxially with the first pipe and penetrating through the downstream lid, a downstream portion of the first pipe having an inner diameter that gradually decreases from an upstream side toward the downstream end, the downstream portion being provided in the main body, and the upstream end of the second pipe being provided in the main body and having a larger inner diameter than the inner diameter of the downstream end of the first pipe.

2. The motorcycle according to claim 1, wherein the main body further comprises:

a first expansion chamber formed on an upstream side in the main body;

a resonator formed on a downstream side of the first expansion chamber; and a first partition plate provided in the main body on a downstream side of a downstream end opening of the first pipe and having a first through hole into which the second pipe is inserted and a second through hole that communicates the first expansion chamber and the resonator, the first expansion chamber and the resonator being separated by the first partition plate.

3. The motorcycle according to claim 1, wherein a plurality of through holes are provided at a circumferential surface of the downstream portion of the first pipe.

4. The motorcycle according to claim 1, wherein the silencer further comprises:

an inner tube inserted in the outer tube and having a circumferential surface provided with a plurality of through holes; and a silencing material disposed between the outer tube and the inner tube.

5. The motorcycle of claim 1, wherein exhaust gas remains substantially undisturbed when flowing from the first pipe to the second pipe.

6. The motorcycle of claim 1, wherein no partition is disposed between the front pipe and the rear pipe such that exhaust gas remains substantially undisturbed when flowing from the first pipe to the second pipe.

7. A motorcycle, comprising:

an engine;

an exhaust pipe into which exhaust gas from the engine flows;

a silencer that discharges the exhaust gas flowing out of the exhaust pipe, the silencer comprising a main body including an outer tube, an upstream lid provided at an upstream end of the outer tube, and a downstream lid provided at a downstream end of the outer tube, the main body further including a first expansion chamber formed on an upstream side in the main body, a first pipe inserted in the main body and having an upstream end into which exhaust gas from the exhaust pipe flows and a downstream end provided in the main body, and a second pipe provided apart from the first pipe on a downstream side of the first pipe and approximately coaxially with the first pipe and penetrating through the downstream lid, a downstream portion of the first pipe having an inner diameter that gradually decreases from an upstream side toward the downstream end, the upstream end of the second pipe being provided in the main body and having a larger inner diameter than the inner diameter of the downstream end of the first pipe, a resonator formed on a downstream side of the first expansion chamber, a first partition plate provided in the main body on a downstream side of a downstream end opening of the first pipe and having a first through hole into which the second pipe is inserted, and a second through hole that communicates the first expansion chamber and the resonator, the first expansion chamber and the resonator being separated by the first partition plate; and a chamber including a plurality of expansion chambers, wherein the exhaust pipe includes:

a first exhaust pipe provided between the engine and the chamber, and a second exhaust pipe provided between the chamber and the silencer, and wherein the chamber further includes a box, a second expansion chamber formed in the box and communicated with the second exhaust pipe, a third expansion chamber formed further to a rear side of the motorcycle than the second expansion chamber, a second partition plate provided between the second expansion chamber and the third expansion chamber, a first communicating pipe having an upstream end connected to the first exhaust pipe and a downstream end provided in the third expansion chamber and penetrating through the second expansion chamber and the second partition plate, and a second communicating pipe having an upstream end provided in the third expansion chamber and a downstream end provided in the second expansion chamber and penetrating through the second partition plate.

8. An exhaust device, comprising:

a chamber, a partition in the chamber forming a front enclosure and a rear enclosure;

a first communicating pipe extending from an upstream end of the chamber through the partition into the rear enclosure;

a second communicating pipe extending between the front enclosure and the rear enclosure; and a muffler connected to the chamber, the muffler including a front pipe and a rear pipe separated from each other, the front pipe being coaxial with the rear pipe and including a tapered portion that tapers toward the rear pipe, the tapered portion being within a main body of the muffler.

9. The exhaust device of claim 8, wherein an inner diameter of the rear pipe is larger than an inner diameter of the front pipe at a rear portion of the front pipe.

10. The exhaust device of claim 8, wherein the muffler further includes a partition forming another enclosure, the front pipe and the rear pipe opening onto the other enclosure.

11. The exhaust device 8, wherein exhaust gas remains substantially undisturbed when flowing from the front pipe to the rear pipe.

12. The exhaust device 8, wherein no partition is disposed between the front pipe and the rear pipe such that exhaust gas remains substantially undisturbed when flowing from the front pipe to the rear pipe.

* * * * *